US012478144B2

(12) United States Patent
Künzli et al.

(10) Patent No.: US 12,478,144 B2
(45) Date of Patent: Nov. 25, 2025

(54) HOLDER FOR CONNECTING A NECK STRAP TO THE HELMET SHELL OF A HELMET

(71) Applicant: ABUS August Bremicker Söhne KG, Wetter-Volmarstein (DE)

(72) Inventors: Daniel Künzli, Mellingen (CH); Mattia Carotto, Quinto Vicentino (IT); Lukas Tamajka, Herdecke (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 99 days.

(21) Appl. No.: 18/651,978

(22) Filed: May 1, 2024

(65) Prior Publication Data

US 2024/0365934 A1 Nov. 7, 2024

(30) Foreign Application Priority Data

May 4, 2023 (DE) ..... 102023111678.9

(51) Int. Cl.
*A44B 11/12* (2006.01)
*A45F 5/02* (2006.01)
(Continued)

(52) U.S. Cl.
CPC ..... *A44B 11/12* (2013.01); *A45F 5/02* (2013.01); *A45F 5/06* (2013.01); *A45F 2005/1006* (2013.01)

(58) Field of Classification Search
CPC ... A44B 11/12; A45F 5/02; A45F 5/06; A45F 2005/1006; A42B 3/085
See application file for complete search history.

(56) References Cited

U.S. PATENT DOCUMENTS 5,608,918 A * 3/1997 Salvaggio ..... A44B 11/02 24/169
5,794,272 A * 8/1998 Workman ..... A42B 3/085 2/421

(Continued)

FOREIGN PATENT DOCUMENTS

DE 4126675 A1 2/1993
DE 202007012116 U1 10/2007

(Continued)

OTHER PUBLICATIONS

German Search Report regarding Application No. 102023111678.9, mailed May 1, 2024.

*Primary Examiner* — David M Upchurch
(74) *Attorney, Agent, or Firm* — Harness, Dickey & Pierce, P.L.C.

(57) ABSTRACT

A holder includes a fastening section for fastening to a helmet shell and a coupling section for connecting to a neck strap. The coupling section has a first side, a second side, a first marginal section, a second marginal section, and one or more connection bridges that each permanently connect the first marginal section and the second marginal section to one another. At least one fixing bridge that can be moved from a position in which it does not connect the first and second marginal sections to one another into a fixing position in which it connects the first and second marginal sections to one another. A continuous center section of the neck strap can be arranged at the connection bridges and a part section of the center section can be brought through a free space where it can be engaged through by the at least one fixing.

20 Claims, 3 Drawing Sheets

(51) Int. Cl.
*A45F 5/06* (2006.01)
*A45F 5/10* (2006.01)

(56) References Cited

U.S. PATENT DOCUMENTS

| | | | | |
|---|---|---|---|---|
| 7,404,534 | B1 * | 7/2008 | Hajianpour | A45F 5/02 248/248 |
| 10,743,601 | B2 * | 8/2020 | Flack | A42B 3/08 |
| 2010/0050324 | A1 | 3/2010 | Musal | |
| 2016/0165998 | A1 | 6/2016 | Musal et al. | |
| 2018/0098593 | A1 | 4/2018 | Von Dunten et al. | |

FOREIGN PATENT DOCUMENTS

| | | | |
|---|---|---|---|
| DE | 102013210520 | A1 | 12/2014 |
| DE | 202017102934 | U1 | 6/2017 |
| DE | 102016119242 | A1 | 4/2018 |
| DE | 102019101412 | A1 | 7/2020 |
| EP | 0527308 | A1 | 2/1993 |
| EP | 1698244 | A2 | 9/2006 |

* cited by examiner

HOLDER FOR CONNECTING A NECK STRAP TO THE HELMET SHELL OF A HELMET

CROSS-REFERENCE TO RELATED APPLICATION

This application claims the benefit of German Application No. 1020231116789, filed on May 4, 2023. The entire disclosure of the application referenced above is incorporated herein by reference.

FIELD

The disclosure relates to a holder for connecting a neck strap to a helmet shell of a helmet, in particular a two-wheeler helmet, and to a helmet comprising such a holder.

BACKGROUND

A helmet serves to protect the head of the respective helmet wearer and typically comprises a helmet shell that is configured to be placed on the head. In this respect, it is usually important that the helmet shell reliably holds on the head. For this purpose, the helmet may have helmet straps with which the helmet may be fastened to the head. For example, it is known for helmets, in particular two-wheeler helmets, to provide temple straps and neck straps that are connected to the helmet shell in the region of a respective temple or the neck of the respective helmet wearer. The temple straps may extend at both sides of the head, in each case past the ear to under the chin of the respective helmet wearer and may be connected to one another there by means of a closure. The neck straps may extend at both sides of the head, in each case past the ear up to the respective temple strap and may be coupled thereto there, wherein they may end at this coupling point or extend from there together with the temple strap up to under the chin.

Said neck straps may also be formed in one part as a continuous neck strap that may then extend from the chin or said coupling point at which it is coupled to the respective temple strap, at the one side of the head up to the connection point in the region of the neck and further at the other side of the head up to the coupling point at which it is coupled to the other temple strap, or may extend up to the chin again. In particular when such a continuous neck strap is provided, the neck strap is therefore not connected to the helmet shell with an end of its extent, but with a center section.

For a secure fastening of the helmet to the head, it is important that the helmet straps are each reliably connected to the helmet shell. For this purpose, different holding structures may be provided at the helmet shell. For example, to connect a center section of a continuous neck strap, it is generally possible to provide a hook-shaped structure, into which the center section may be hung, at the helmet shell in the region of the neck. However, for a reliable connection, it is expedient if it is ensured that the center section cannot detach from the holder. It is therefore preferred if the holder has at least one structure closed in a ring shape that encloses the center section of the neck strap.

However, a disadvantage of this may be that the center section has to be threaded through such a structure closed in a ring shape, which may complicate the manufacture, in particular an automated manufacture, of the helmet. This is in particular the case if the continuous neck strap is formed in one part with the two temple straps so that it branches at said coupling points (a method for manufacturing such a helmet strap is described in DE 10 2016 119 242 A1). At least one of the branches would therefore have to be threaded through the structure of the holder closed in a ring shape, which is difficult or even impossible under certain circumstances depending on the size of the holder.

SUMMARY

It is an object of the disclosure to provide a holder for connecting a neck strap to a helmet shell of a helmet and a helmet comprising such a holder that enable a simple and reliable connection of the neck strap.

The holder according to the disclosure serves to connect a neck strap to a helmet shell of a helmet, in particular a two-wheeler helmet, wherein the holder has a fastening section for fastening to the helmet shell and a coupling section for connecting the neck strap. The coupling section in this respect has a first side and a second side that are opposite one another with respect to a normal direction, further has a first marginal section and a second marginal section which are arranged opposite one another with respect to a longitudinal direction perpendicular to the normal direction and between which a free space is formed, and further comprises one or more connection bridges that each permanently connect the first marginal section and the second marginal section to one another. In this respect, the holder further comprises at least one fixing bridge that may be moved from a position in which it does not connect the first marginal section and the second marginal section to one another into a fixing position in which it connects the first marginal section and the second marginal section to one another and said holder is configured, in particular with respect to the arrangement of the one or more connection bridges and with respect to the arrangement and/or movability of the at least one fixing bridge, such that a continuous center section of the neck strap may be arranged at the one or more connection bridges at the first side of the coupling section and a part section of the center section may be brought through the free space to the second side of the coupling section where it (i.e. the part section) may be engaged through by the at least one fixing bridge by moving the latter into its fixing position and may thereby be secured against a return to the first side of the coupling section.

The holder in particular serves to connect a continuously designed neck strap, i.e. one that extends with an uninterrupted course from a first end to a second end. The neck strap may be formed in one part in this respect, but this does not rule out that it is branched and therefore has more than two ends. Said first end and said second end of the neck strap may each be connected to a respective temple strap of the helmet and/or may be configured to be coupled to one another by means of a closure. For this purpose, the neck strap may be configured to extend up to under the chin of the respective helmet wearer.

The holder may be configured to be fastened to a rear section of the helmet shell in the region of the neck of a respective helmet wearer. For fastening to the helmet shell, the holder has said fastening section and for connecting the neck strap, the holder has said coupling section. In this way, the helmet shell itself does not need to have a structure suitable for connecting the neck strap. However, the fastening section and, if necessary, other parts of the holder may generally also be formed as integrated into the helmet shell.

The fastening section and the coupling section of the holder may be arranged spaced apart from one another along said longitudinal direction, for example at ends of the holder that are opposite one another with respect to the longitudinal direction. The holder may further have a mechanism for length adjustment by which the spacing between the fastening section and the coupling section and/or the position of the holder relative to the helmet shell may be adjusted. In this way, the position of the connection of the neck strap relative to the helmet shell may be adjustable along the longitudinal direction, which substantially corresponds to a height adjustment of the connection point relative to the head of the helmet wearer.

The coupling section has two sides that face in opposite directions with respect to a normal direction perpendicular to the longitudinal direction, namely said first side and said second side. These sides may also be regarded as the front and rear side of the holder in that one of the sides (front side) at least substantially faces in that direction in which, when the holder is fastened to the helmet, the front side of the helmet also faces, while the other side (rear side) faces at least substantially in that direction in which, when the holder is fastened to the helmet, the rear side of the helmet also faces. In this respect, the helmet expediently has a shape adapted to a typical head so that a clear distinction may be made for the helmet between a front side, which is arranged in the region of the forehead of the head of the respective helmet wearer when the helmet is put on, and a rear side that is arranged in the region of the neck of the head of the respective helmet wearer when the helmet is put on. In general, said first side may either be the front side of the holder so that said second side is the rear side of the holder or the second side may be the front side of the holder so that the first side is the rear side of the holder. The first side is preferably the rear side of the holder.

The coupling section has said free space that may in particular form a passage between the first side and the second side of the holder. Along the longitudinal direction, the free space is bounded, on the one hand, by said first marginal section and, on the other hand, by said second marginal section. The free space therefore corresponds to a region between the first marginal section and the second marginal section that is free, wherein the free space may also be divided into two or more intermediate spaces.

The first marginal section and the second marginal section of the coupling section are in particular permanently connected to one another by the one or more connection bridges in that they each extend from the first marginal section to the second marginal section and are permanently connected to both the first marginal section and the second marginal section. Said connection bridges preferably have an at least substantially parallel course to the longitudinal direction.

If the connection bridges are generally referred to in the plural here or in the following, this may nevertheless only refer to one connection bridge, depending on whether only the one or a plurality of connection bridges are provided. This therefore does not rule out the possibility that only a single connection bridge is provided.

If the coupling section comprises a plurality of connection bridges, they are preferably arranged distributed along a transverse direction perpendicular to the normal direction and the longitudinal direction. In this respect, the connection bridges may at least substantially lie in a plane that is spanned by the longitudinal direction and the transverse direction.

Since the one or more connection bridges connect the first marginal section and the second marginal section to one another, they span said free space. The free space may thereby be laterally bounded by the connection bridges, i.e. with respect to the mentioned transverse direction perpendicular to the normal direction and the longitudinal direction, and/or divided into two or even more intermediate spaces.

The connection of the one or more connection bridges to the marginal sections is in particular permanent in that it is not designed as releasable. The one or more connection bridges are preferably connected to the marginal sections in a materially bonded manner. The connection bridges may in particular be integrally formed with the marginal sections. In this regard, the entire coupling section, which has the marginal sections and comprises the connection bridges, may be formed in one part. The first marginal section and the second marginal section as well as the one or more connection bridges are preferably all manufactured together in an already mutually connected state. A connection is here preferably to be understood as a direct connection in each case; the one or more connection bridges are therefore each not merely indirectly connected via additional elements to the marginal sections, but are arranged directly at them or merge directly into them.

The at least one fixing bridge differs from the one or more connection bridges at least in that it does not permanently connect the first marginal section and the second marginal section of the coupling section to one another. For the fixing bridge may assume at least one position in which it does not connect the first marginal section and the second marginal section to one another, i.e. it is not connected at least either to the first marginal section or to the second marginal section. Such a position in which the fixing bridge does not connect the first marginal section and the second marginal section to one another may be regarded as a pre-assembly position (since the fixing bridge only assumes this position before the neck strap is connected to the helmet shell via the holder). As a rule, the fixing bridge may assume a plurality of such positions. Therefore, the pre-assembly position does not have to be clearly defined, but a plurality of positions in which the fixing bridge does not connect the first marginal section and the second marginal section to one another may be considered as the pre-assembly position.

Since the fixing bridge may assume at least one such pre-assembly position in which it does not connect the first and the second marginal section to one another, the at least one fixing bridge may be permanently connected to one of the two marginal sections, but not to both. However, the at least one fixing bridge may be moved from the pre-assembly position into the fixing position in which it then connects the first marginal section and the second marginal section to one another, in particular by extending in the fixing position, for example with a course at least substantially parallel to the longitudinal direction, from the first marginal section to the second marginal section and thereby being connected to both the first marginal section and the second marginal section. Similar to the connection bridges, in connection with the at least one fixing bridge, a connection should preferably also be understood as a direct connection in each case.

At least one of the two connections which the fixing bridge has in its fixing position with the first marginal section or with the second marginal section is therefore not already present in the pre-assembly position, but only results when the fixing bridge has been moved from the pre-assembly position into its fixing position. This at least one connection may in particular be a mechanical coupling that may preferably be brought about by moving the fixing bridge from the pre-assembly position into the fixing position. In general, the connection, however, does not need a specific mechanical design, but may in each case consist in a mere contact of the fixing bridge with the first marginal section or the second marginal section.

Provision may be made that the fixing bridge, by moving or after moving into the fixing position, is connected to the first marginal section and/or to the second marginal section such that it is ultimately permanently connected to both the first marginal section and the second marginal section. Unlike the one or more connection bridges, the fixing bridge is, however, not permanently connected to both the first marginal section and the second marginal section from the outset. In particular, the fixing bridge is not manufactured in a state already permanently connected to both the first marginal section and the second marginal section.

In its fixing position, the at least one fixing bridge spans said free space in a similar manner to the one or more connection bridges. Said at least one fixing bridge may thereby divide the free space into intermediate spaces or bound it laterally, i.e. with respect to the transverse direction mentioned. In this regard, the at least one fixing bridge substantially acts like a further connection bridge in its fixing position. The at least one fixing bridge is preferably, in particular solely, arranged at the second side of the coupling section. In contrast, the connection bridges are preferably at least also or solely arranged at the first side of the coupling section.

When designs or possible designs of the at least one fixing bridge are described here, if the holder comprises more than only one fixing bridge, it is not only meant that at least one of these plurality of fixing bridges is or may be formed in the manner described, but it is in each case also meant that each of the plurality of fixing bridges may in each case be formed in the manner described.

If more than only one fixing bridge is provided, the fixing bridges are preferably arranged distributed along a transverse direction perpendicular to the normal direction and the longitudinal direction. In this respect, the fixing bridges may at least substantially lie in a plane that is spanned by the longitudinal direction and the transverse direction. This plane may in particular be provided at said second side of the coupling section so that the fixing bridges are also at least substantially arranged at the second side of the coupling section.

The one or more connection bridges and the at least one fixing bridge are referred to as bridges since the connection bridges and the fixing bridge (at least in its fixing position) bridge the free space between the first marginal section and the second marginal section of the coupling section of the holder. However, the designation as a bridge is not otherwise intended to imply a particular structure. However, said bridges are preferably elongate and may, for example, have a rod shape or pin shape. Other shapes and structures are generally also conceivable, however.

The arrangement of the one or more connection bridges and the arrangement and/or movability of the at least one fixing bridge are advantageous such that the structure of the holder enables the following procedure for connecting the neck strap: A continuous center section of the neck strap may be arranged at the one or more connection bridges at the first side of the coupling section; a part section of the center section may subsequently be brought through said free space to the second side of the coupling section where it may be engaged through by the at least one fixing bridge by moving the latter (from said pre-assembly position) into its fixing position and may thereby be secured against a return to the first side of the coupling section.

The continuous center section is a center section of the neck strap in that it is arranged between said ends of the neck strap and therefore does not comprise either the first end or the second end (and, if present, no other end) of the neck strap. However, the center section does not necessarily have to be positioned exactly at the center between the first end and the second end. The center section is continuous in particular in that it has an uninterrupted course.

If at least two connection bridges are provided, the part section may in this respect in particular be brought between two connection bridges to the second side of the coupling section. If the free space is divided into one or more intermediate spaces by the connection bridge or a respective one of the plurality of connection bridges, the part section may be brought through one of the intermediate spaces to the second side of the coupling section. Provision may also be made that two or more different part sections of the center section of the neck strap may be brought through a respective one of a plurality of intermediate spaces, into which the free space is divided by the connection bridges, to the second side of the coupling section.

The center section may, preferably with a course parallel to the transverse direction mentioned, be arranged, in particular placed against, the one or more connection bridges at the first side of the coupling section. Subsequently, said part section of the center section may be brought, in particular pulled or pushed, through the free space to the second side of the coupling section without the center section having to move away from the connection bridges. The holder may consequently be configured such that a part section of the center section is brought through the free space to the second side of the coupling section, whereas the part section contacts the one or more connection bridges at the first side of the coupling section.

For the connection of the neck strap, it is thus in particular not necessary to thread the neck strap into the holder in that one end of the neck strap is threaded through the free space (or an intermediate space into which the free space is divided by the one or more connection bridges) and thus moves from the first side of the coupling section to the second side of the coupling section. Rather, it is sufficient to bring said part section of the center section through the free space (or, if applicable, a plurality of part sections through a respective one of said intermediate spaces) to the second side of the coupling section, while the remaining center section remains at the first side of the coupling section.

The center section therefore extends from the first side of the coupling section through the free space to the second side and back through the free space to the first side again. The part section brought to the second side therefore forms a kind of loop. This loop may then be engaged through at the second side of the coupling section by the fixing bridge in its fixing position. In other words, the part section may be arranged at the second side of the coupling section such that the movement of the fixing bridge (from said pre-assembly position) into its fixing position causes the fixing bridge to engage through the part section, namely the loop formed by the part section.

This engaging through then ensures a form-fitting securing of the part section against leaving the second side through the free space back to the first side and thus a reliable securing of the neck strap against a release from the helmet shell. The form fit is in this respect related to said normal direction in which the part section as a whole cannot return to the first side of the coupling section due to the engaging through of the fixing bridge. However, a pulling through of the neck strap substantially parallel to the transverse direction mentioned is not necessarily prevented so that the part section of the center section, which is currently located at the second side of the coupling section and engaged through by the fixing bridge, may change as a result of pulling. The neck strap could generally be pulled so far along the transverse direction that it is unthreaded from the coupling section of the holder. However, this is advantageously prevented in that the neck strap is coupled to temple straps of the helmet or is formed in one part and the neck strap, due to the thus branched strap path, cannot be unthreaded through the free space up to one of its ends.

In summary, the holder makes it possible to place the neck strap with a center section of its continuous course against the holder at the first side of the coupling section, to push a comparatively small part section of the center section through the free space and to engage through the loop thus formed at the second side of the coupling section with the fixing bridge, whereby the neck strap is then reliably connected to the holder and via the holder to the helmet shell of the respective helmet.

According to an advantageous embodiment, at least three bridges (connection bridges or fixing bridges) are provided. For example, the holder may comprise at least two connection bridges and at least one fixing bridge, wherein the fixing bridge is then preferably arranged between the two connection bridges with respect to a transverse direction perpendicular to the normal direction and the longitudinal direction; the holder may also comprise at least two fixing bridges and at least one connection bridge, wherein the connection bridge is then preferably arranged between the two fixing bridges with respect to a transverse direction perpendicular to the normal direction and the longitudinal direction.

In general, it is advantageous if the connection bridges and fixing bridges are alternately arranged such that the center section of the neck strap may have a slalom-like course around the bridges, in particular such that (at least) one connection bridge at the first side of the coupling section and (at least) one fixing bridge at the second side of the coupling section is alternately passed by the neck strap in each case. Due to such a course, a slipping through of the neck strap may advantageously be blocked or at least braked in a friction-locked manner along the transverse direction mentioned by the coupling section of the holder, namely blocked or braked the more, the more neck strap is tensioned, as is usually the case when the helmet is closed. However, in a loose state, for example when the helmet is open, a slipping through is possible to a certain extent, which may be useful for adjusting the helmet to the head of the respective helmet wearer.

To prevent an unintentional slipping through of the neck strap, according to an advantageous embodiment, provision may be made that the one or more connection bridges and/or the at least one fixing bridge has/have a braking structure that increases the friction between the neck strap and the respective connection bridge or fixing bridge. The friction is in this respect increased compared to that friction which would be present without the braking structure, in particular if the respective bridge had an at least substantially smooth surface instead of the braking structure. Such a braking structure may, for example, comprise a corrugation of the surface of the respective bridge. Alternatively or additionally thereto, the braking structure may comprise a plurality of projections in the manner of a toothing that are formed at the respective bridge and are preferably oriented towards a bridge adjacent thereto, between which bridge and the respective bridge the neck strap fastened to the holder extends.

The at least one fixing bridge may generally be formed completely separately from the coupling section. In this respect, the separate design in particular refers to the manufacture and thus to the state after the manufacture of the coupling section, on the one hand, and the manufacture of the fixing bridge independent thereof, on the other hand. After the neck strap has been connected to the holder, i.e. when the fixing bridge engages through the part section of the center section of the neck strap, the fixing bridge, which is actually formed separately from the coupling section, may subsequently be connected to the coupling section, by all means also in a materially bonded manner, for example by welding or adhesive bonding. A separate design makes it possible to manufacture the fixing bridge from a different material, for example from metal, than the rest of the holder that may be made of plastic, for example. The fixing bridge may in particular be configured as a metal pin separate from the coupling section. In a separate design of the fixing bridge, any position in which the fixing bridge is not arranged at the coupling section may generally be regarded as said pre-assembly position.

As an alternative to a separate design, the at least one fixing bridge may be integrally formed with the coupling section according to an advantageous embodiment. In this respect, the integral design in particular relates to the manufacture. In such an embodiment, the coupling section and the at least one fixing bridge are therefore already manufactured in one part and are not only subsequently connected to one another for the first time. The fixing bridge may in particular be integrally formed with one of the aforementioned marginal sections of the coupling section and may thereby be permanently connected to the first marginal section or the second marginal section. The integral design of the fixing bridge with the coupling section is, for example, advantageous in that the manufacture of the holder requires fewer separate processes and the fixing bridge cannot be lost. The entire holder may in particular be formed in one part. By selecting a suitable material, in particular a plastic, and different material thicknesses, in particular a small material thickness of the transition between the coupling section and the fixing bridge, it may be achieved that the fixing bridge may be movable despite the integral design with the coupling section and that the coupling section has a stable structure in this respect.

According to a further advantageous embodiment, the coupling section has, at its second side, a guide into which the fixing bridge is inserted in its fixing position. The guide is in this respect advantageously configured to guide the movement of the fixing bridge into its fixing position. The guide is preferably further configured to hold the fixing bridge in its fixing position so that the fixing bridge reliably connects the first marginal section and the second marginal section of the coupling section of the holder. The aforementioned embodiment may in particular be advantageous if the fixing bridge is formed separately from the coupling section.

The guide may comprise a first guide part, which is formed at the first marginal section and which may guide the fixing bridge and possibly hold it after reaching the fixing position, and a second guide part that is formed at the second marginal section and that may guide the fixing bridge and possibly hold it after reaching the fixing position. In particular if the fixing bridge is permanently connected to one of the two marginal sections, the guide may also be formed solely at the other marginal section to guide the movement of the fixing bridge into its fixing position and, if applicable, to also hold the fixing bridge in the fixing position, in which the fixing bridge is connected to the other marginal section, at the other marginal section. The guide may be configured as a receiver into which the fixing bridge may be placed, pushed or inserted in another way. Such a receiver may be formed at the first marginal section and/or at the second marginal section so that a respective section of the fixing bridge (in particular a respective one of the support sections of the fixing bridge explained further below) may be inserted into the respective receiver.

The guide may in particular be configured such that the fixing bridge may be inserted into the guide along said longitudinal direction. If the fixing bridge has a rod shape or pin shape that extends along a longitudinal axis, the guide may alternatively or additionally be configured such that the fixing bridge, when moving into its fixing position, is axially inserted into the guide with respect to its longitudinal axis and is guided by the guide in so doing. For example, the guide may then have the shape of a passage bore or, if the guide comprises said first guide part and said second guide part, comprise two mutually aligned passage bores.

According to a further advantageous embodiment, the at least one fixing bridge has a first support section with which it is arranged at the first marginal section in the fixing position and a second support section with which it is arranged at the second marginal section in the fixing position. The support sections may in particular be end sections of a longitudinal extent of the at least one fixing bridge. However, the at least one fixing bridge may generally also extend beyond the respective support section at one or both sides. In its fixing position, the at least one fixing bridge may then, with a center section extending between the support sections, engage through the part section of the center section of the neck strap brought through said free space to the second side of the coupling section. The two support sections are consequently arranged at mutually opposite sides of said engaging through of the part section of the center section of the neck strap.

In its fixing position, the at least one fixing bridge is, preferably at the second side of the coupling section, arranged at the first marginal section with its first support section and at the second marginal section with its second support section. In general, the support sections of the at least one fixing bridge may in this respect simply contact the marginal sections of the coupling section and be held there by the tension of the neck strap, for example. However, the connection between a respective support section of the at least one fixing bridge and the respective marginal section of the coupling section of the holder is preferably firmer in that the first support section is fastened to the first marginal section or the second support section is fastened to the second marginal section.

In its fixing position, the at least one fixing bridge may in particular be arranged at the first marginal section with its first support section and at the second marginal section with its second support section such that both support sections are secured, preferably in a form-fitting manner, against passing through the free space towards the first side of the coupling section. The form-fitting securing may, for example, arise in that the at least one fixing bridge is supported with its support sections against the second side of the coupling section. The at least one fixing bridge is therefore arranged such that it cannot simply be pulled by the center section of the neck strap through the free space to the first side of the coupling section of the holder. The form-fitting support at both sides may, possibly in addition to a fastening of one or both support sections to the respective marginal section, as it is described below, contribute to a reliable securing of the center section of the neck strap to the coupling section of the holder.

According to an advantageous further development of the above embodiment, in the fixing position of the at least one fixing element, at least one of the two support sections is fastened or fastenable to the coupling section, namely in particular to the respective marginal section of the coupling section, in a form-fitting and/or materially bonded manner. If both support sections are fastened to a respective one of the marginal sections, both support sections do not necessarily have to be fastened in the same way.

The form-fitting fastening may preferably be established without tools. For example, the form-fitting fastening may take place by snapping in or clipping in. For this purpose, a receiver for the respective support section of the at least one fixing element may be formed at the respective marginal section at the second side of the coupling section, which receiver may have latching means, such as latching projections, for a latching reception of the respective support section. A closure mechanism may also be provided between the respective support section of the at least one fixing element and the respective marginal section of the coupling section of the holder for the form-fitting fastening.

The alternatively or additionally provided bonded fastening may, for example, take place by welding or adhesive bonding. In this respect, fastening does not refer to a bonded connection, which has already been present since the manufacture anyway, of the at least one fixing element that is possibly integrally formed with the coupling section, but rather to an only subsequently produced fixed connection.

According to an advantageous further development, the fastening is irreversible. In other words, the fastening with which at least one of the two support sections of the at least one fixing element is connected to a respective one of the two marginal sections of the holder is not adapted to be released again. The fastening may in particular be such that it cannot be released non-destructively. This does not only apply to the bonded fastening, but may also apply to the form-fitting fastening, for example by providing a non-releasable latching connection for fastening. Such a latching connection may, for example, have barbs as latching means that indeed allow a latching, but lock in the opposite direction. For example, the fastening may take place in the manner of a cable tie.

According to a further advantageous embodiment, one of the two support sections is connected in an articulated manner to the coupling section, in particular to the respective marginal section of the coupling section. This is preferably a permanent connection so that the at least one fixing bridge is connected in an articulated manner to the coupling section both in said pre-assembly position and in its fixing position. Due to the articulated connection, the movement of the at least one fixing bridge from the pre-assembly position into the fixing position may correspond to a pivoting around the articulated joint. The at least one fixing bridge may then be pivotable by the articulated joint about a pivot axis that is perpendicular to the direction in which the fixing bridge engages through the part section of the center section of the neck strap brought through the free space to the second side of the coupling section and/or that is perpendicular to said longitudinal direction. The pivot axis may in particular be parallel to the mentioned transverse direction that is in turn perpendicular to the longitudinal direction and the normal direction.

If the at least one fixing bridge is integrally formed with the coupling section, one of the support sections may advantageously be connected in an articulated manner to the coupling section, in particular to the respective marginal section of the coupling section, via a film hinge or film joint.

Such a film hinge or film joint may in particular be formed by providing a material thinning along the joint axis about which the at least one fixing bridge is to be pivotable, which material thinning allows a bending of the material at the one side of the material thinning relative to the material at the other side of the material thinning. A plastic material is in particular suitable in this respect.

The helmet according to the disclosure comprises a helmet shell for placing on the head of a respective helmet carrier and a neck strap for fastening the helmet to the head, wherein a holder according to the disclosure for connecting the neck strap is provided at the helmet shell, which holder may in particular be configured in one of the ways described above.

The helmet shell may, for example, comprise a shell-shaped helmet body made of solid foam and a thin cover shell, for example made of ABS (acrylonitrile butadiene styrene plastic), placed thereon. The neck strap does not necessarily have to be the only fastening means, but further helmet straps, for example a temple strap at each side, may in particular also be provided. The holder, with its fastening section, is preferably non-releasably fastened to the helmet shell, namely in particular to a rear section of the helmet shell that is arranged in the region of the neck of the respective helmet wearer when the helmet is placed on the head. In this respect, the helmet shell is expediently adapted to standard head shapes and is thereby defined for a clear alignment in the state of the helmet placed on. The holder may be adjustable in length so that the position of the connection of the neck strap may be varied along a path extending at least substantially vertically in the region of the neck of the respective helmet wearer.

According to an advantageous embodiment, the neck strap extends continuously from a first end to a second end and, with a center section of its extent, which (as also explained further above) therefore has a continuous course, is arranged between the ends and comprises neither the first end nor the second end of the neck strap, contacts the one or more connection bridges at the first side of the coupling section, wherein a part section of the center section extends through the free space to the second side of the coupling section where it is engaged through by the at least one fixing bridge in its fixing position so that said part section of the center section is secured against a return to the first side of the coupling section. In this way, the neck strap is then reliably secured to the holder and connected to the helmet shell via the holder. In this respect, the center section may in particular have a course that is at least substantially perpendicular to the normal direction and the longitudinal direction (and thus at least substantially parallel to the transverse direction mentioned). Furthermore, the center section may have a slalom-like course between the one or more connection bridges and the at least one fixing bridge, wherein it passes the one or more connection bridges preferably in each case at the first side of the coupling section and passes the at least one fixing bridge preferably at the second side of the coupling section.

The neck strap may in particular be configured as an areal strap having two mutually opposite side surfaces. According to a further advantageous embodiment, the center section of the neck strap contacts the one or more connection bridges with a first side surface (of the two mentioned side surfaces) of the neck strap and contacts the at least one respective fixing bridge with a second side surface (of the two mentioned side surfaces) of the neck strap opposite said first side surface. The neck strap thereby has plenty of contact with the one or more connection bridges and the at least one fixing bridge without taking up too much space. The contact with the bridges in particular contributes towards the neck strap, in particular in the tightened state with the helmet put on and the helmet straps closed, being secured by friction against slipping through the holder along the transverse direction mentioned.

BRIEF DESCRIPTION OF DRAWINGS

The disclosure will be further explained only by way of example in the following with reference to the Figures.

DETAILED DESCRIPTION

Figure 1:
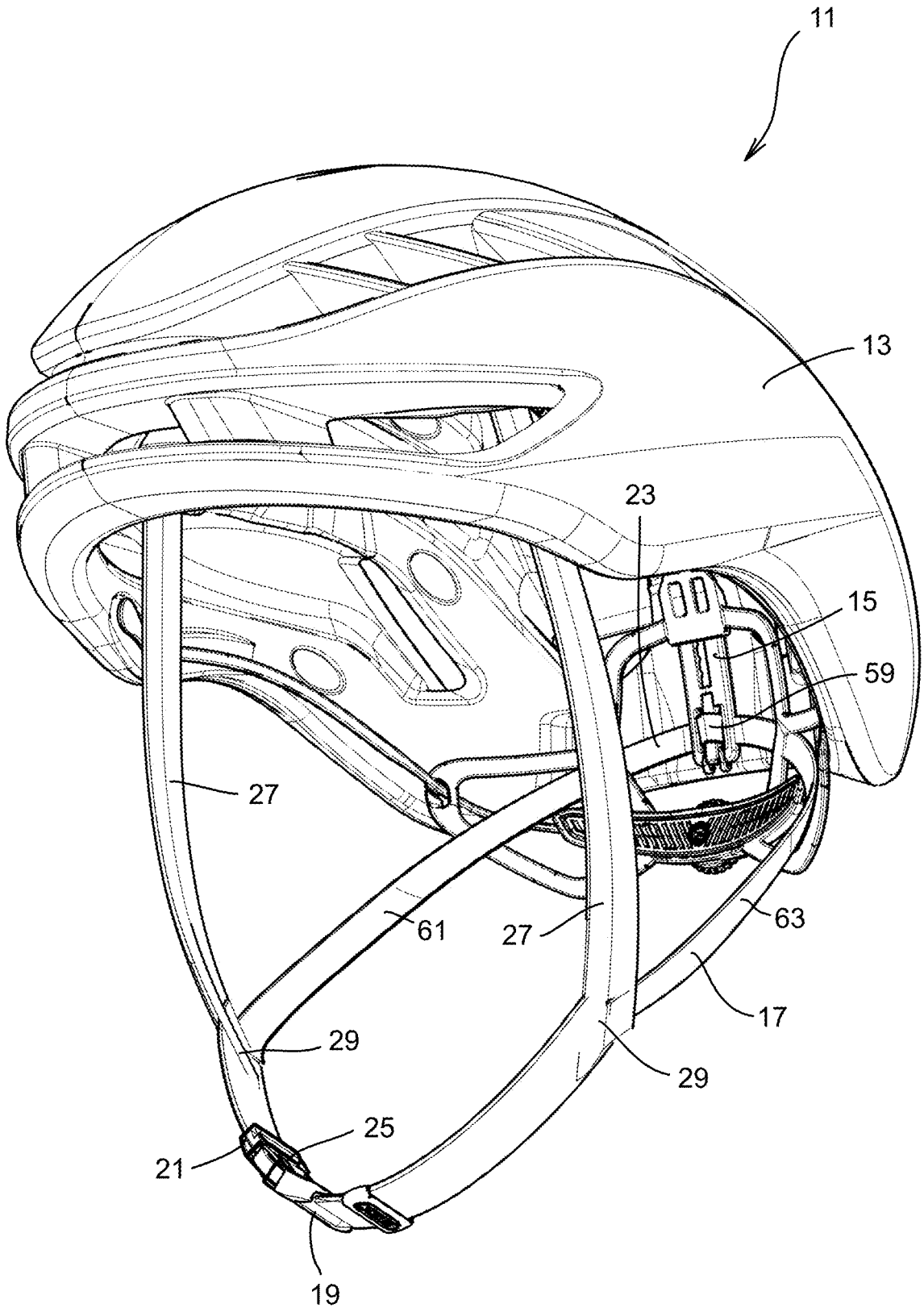
FIG. 1 shows a helmet according to the disclosure that comprises a holder according to a first embodiment of the disclosure.

In FIG. 1, a helmet 11 according to the disclosure is shown that comprises a helmet shell 13 formed in a generally known manner. The helmet shell 13 is configured to be placed on the head of a helmet wearer and is adapted to a typical head shape for this purpose. A front side of the helmet shell 13, which corresponds to a front side of the helmet 11, is in this respect arranged in the region of the forehead of the helmet wearer, while a rear side of the helmet shell 13, which is opposite the front side and corresponds to a rear side of the helmet 11, is arranged in the region of the neck of the helmet wearer.

A holder 15 is provided at the helmet shell 13 at this rear side and serves to connect a neck strap 17 that extends continuously from a first end 19 to a second end 21. In this respect, the holder 15 is specifically configured such that a center section 23 of the neck strap 17 located between the ends 19, 21 of the neck strap 17 may be fastened to the rear side of the helmet shell 13, and thus in the region of the neck of the respective helmet wearer, by means of the holder 15 without having to thread one of the ends 19, 21 through the holder for this purpose. The neck strap 17 fastened to the helmet shell 13 in this way may then extend from the rear side of the helmet shell 13 along both sides of the head of the helmet wearer, in each case extending below the ear, up to under the chin of the helmet wearer where the two ends 19, 21 of the neck strap 17 may be coupled to one another by means of a closure 25.

Furthermore, the helmet 11 has two temple straps 27 that are fastened to opposite sides of the helmet shell 13, in each case in the region of a temple of the respective helmet wearer and also extend from there to under the chin of the helmet wearer. The temple straps 27 in this respect each meet the neck strap 17 at a respective coupling point 29 and have a common course with the neck strap 17 from the coupling point 29 up to the respective end 19, 21 or up to said closure 25. In the embodiment shown in FIG. 1, the neck strap 17 is formed in one part with the temple straps 27.

Figure 3:
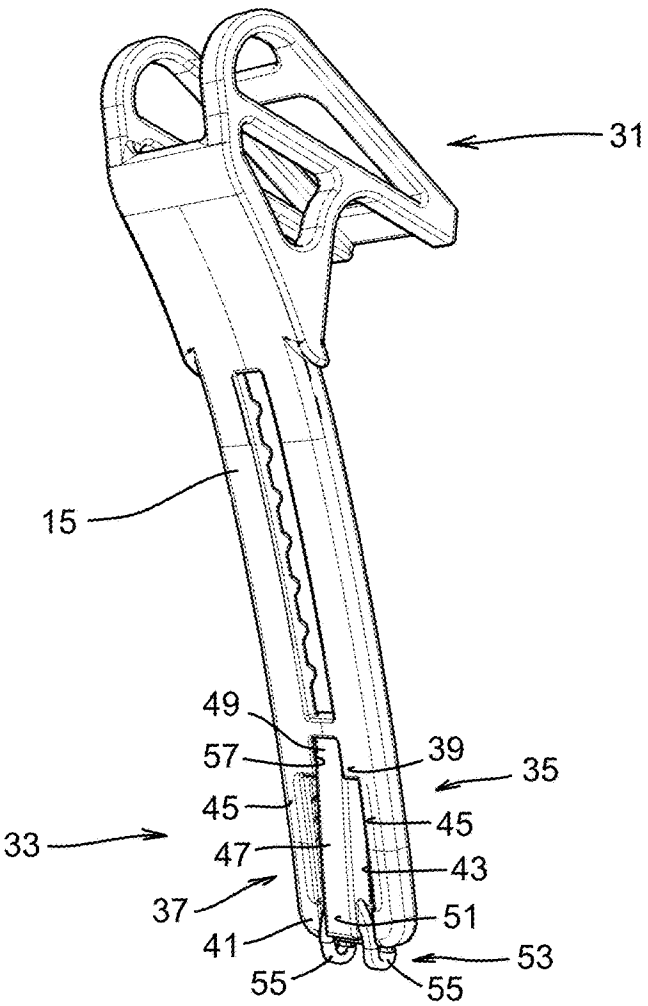
FIGS. 2 and 3 show the holder configured according to the first embodiment separately, wherein a fixing bridge of the holder is shown in a pre-assembly position in FIG. 2 and in a fixing position in FIG. 3.
Figure 2:
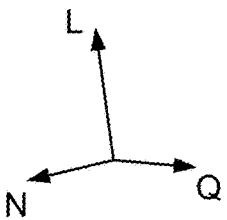
Figure 2:
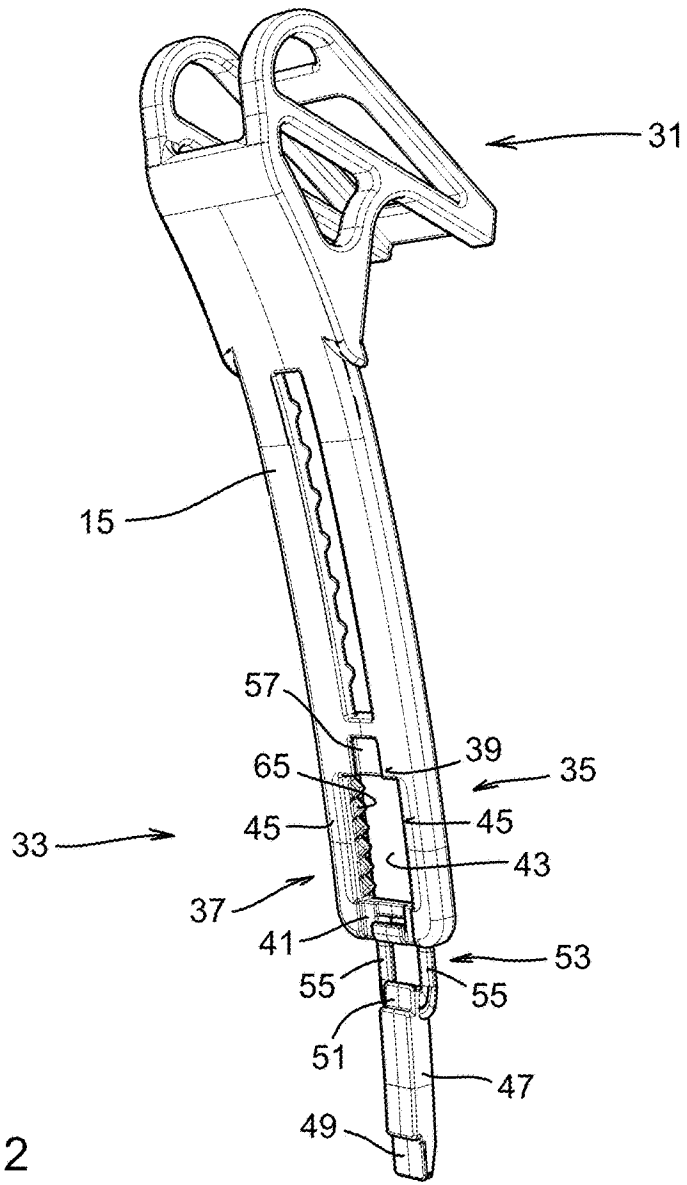

The holder 15 provided at the helmet 11 shown in FIG. 1 is shown separately in FIGS. 2 and 3 so that details of the holder 15 can be better recognized.

The holder 15 is made of plastic and has a fastening section 31, with which it is fastened to the helmet shell 13 (cf. FIG. 1), and a coupling section 33 that serves to connect the neck strap 17. The fastening section 31 and the coupling section 33 are in this respect arranged at opposite ends of the longitudinal extent of the holder 15 along a longitudinal direction L. The coupling section 33 has a first side 35 (which in the first embodiment also corresponds to a rear side of the holder 15) and a second side 37 (which in the first embodiment also corresponds to a front side of the holder 15) that are opposite to one another with respect to a normal direction N perpendicular to the longitudinal direction L. In FIGS. 1 to 3, the viewing direction is in each case such that only the second side 37 of the coupling section 33 of the holder 15 can be seen.

The coupling section 33 has a first marginal section 39 and a second marginal section 41 between which a free space 43 is formed. The two marginal sections 39, 41 are in this respect arranged opposite one another with respect to the longitudinal direction L and thereby bound the free space 43 with respect to the longitudinal direction L. With respect to a transverse direction Q perpendicular to the longitudinal direction L and the normal direction N, the free space 43 in the first embodiment shown in FIGS. 1 to 3 is bounded by two connection bridges 45 that permanently connect the first marginal section 39 and the second marginal section 41 to one another. The coupling section 33 is formed in one part in this respect so that the connection bridges 45 and the marginal sections 39, 41 are connected to one another in a materially bonded manner.

The marginal sections 39, 41 have a course parallel to the transverse direction Q and the connection bridges 45 have a course parallel to the longitudinal direction L. The free space 43 bounded by the marginal sections 39, 41 and the connection bridges 45 thereby has an at least substantially rectangular shape overall.

The holder 15 further comprises a fixing bridge 47 that has an elongate shape that extends from a first support section 49 of the fixing bridge 47 to a second support section 51 of the fixing bridge 47. With the second support section 51, the fixing bridge 47 is connected to the second marginal section 41 of the coupling section 33 via an articulated joint in the form of a film hinge 53. The film hinge 53 is in this respect formed by two hinge strands 55 that are made of the same plastic as the coupling section 33 and the fixing bridge 47, but in contrast thereto are flexible without damage due to the smaller material thickness. The fixing bridge 47 is thereby connected to the coupling section 33 in a materially bonded manner via the film hinge 53, but is movable relative to the coupling section 33 about a pivot axis parallel to the transverse direction Q. The bonded connection of the fixing bridge 47 to the coupling section 33 allows the entire holder 15 to be formed in one part.

Due to said articulated joint, the fixing bridge 47 may be moved from the pre-assembly position shown in FIG. 2, in which the first support section 49 of the fixing bridge 47 is spaced apart from the first marginal section 39 of the coupling section 33 of the holder 15, into the fixing position shown in FIGS. 1 and 3 in which the first support section 49 of the fixing bridge 47 is connected to the first marginal section 39 of the coupling section 33 of the holder 15 so that the fixing bridge 47, similarly to the connection bridges 45, connects the first marginal section 39 and the second marginal section 41 to one another.

For the connection between the first support section 49 of the fixing bridge 47 and the first marginal section 39 of the coupling section 33, the coupling section 33 has, at its mentioned second side 37 in the region of the first marginal section 39, a guide 57 into which the fixing bridge 47 is inserted in its fixing position. The guide 57 is in this respect configured as a receiver into which the first support section 49 of the fixing bridge 47 is received when moving into its fixing position. The first support section 49 and the guide 57 are in this respect formed in a mutually complementary manner. Furthermore, at the first support section 49 and/or at the guide 57, respective latching means may be provided by which the first support section 49 is secured against leaving the guide 57 so that the first support section 49 is fixed, in particular irreversibly, to the first marginal section 39 of the coupling section 33.

In its fixing position, the fixing bridge 47 is at least substantially aligned in parallel with the longitudinal direction L and thus with the connection bridges 45. With respect to the transverse direction Q, the fixing bridge 47 is arranged centrally between the two connection bridges 45. The fixing bridge 47 thereby divides the free space 43 into two intermediate spaces in its fixing position.

In the longitudinal direction L, the fixing bridge 47 extends beyond the free space 43 in its fixing position so that its first support section 49 is arranged at the first marginal section 39 and its second support section 51 at the second marginal section 41 of the coupling section 33 of the holder 15. In its fixing position, the fixing bridge 47 is thereby secured in a form-fitting manner against passing through the free space 43 towards the first side 35 of the coupling section 33.

The described design of the holder 15 makes it possible that, while the fixing bridge 47 is initially in its pre-assembly position, said continuous center section 23 of the neck strap 17 (cf. FIG. 1), with a course substantially parallel to the transverse direction Q, is arranged at the connection bridges 45 at the first side 35 of the coupling section 33 and a part section 59 of the center section 23 is then brought through the free space 43 between the connection bridges 45 to the second side 37 of the coupling section 33 where it forms a kind of loop since the neck strap 17 then extends from the first side 35 through the free space 43 to the second side 37 and back through the free space 43 to the first side 35; this loop may then be engaged through by the fixing bridge 47 by pivoting the fixing bridge 47 into its fixing position in which it divides the free space 43 into two intermediate spaces. Therefore, the neck strap 17 then extends from the first side 35 of the coupling section 33 through one of these intermediate spaces to the second side 37 of the coupling section 33, extends around the fixing bridge 37 there and subsequently extends through the other intermediate space back to the first side 35 of the coupling section 33. The neck strap 17 is thereby connected to the holder 15 and via the holder 15 to the helmet shell 13 (cf. FIG. 1). In this respect, the fixing bridge 47 reliably prevents, in particular due to its support at the marginal sections 39, 41, said part section 59 of the center section 23 of the neck strap 17 from being able to leave the second side 39 through the free space 43 again.

The neck strap 17 connected to the holder 15 in this way extends in a slalom-like manner around the two connection bridges 45, which it passes in each case at the first side 35 of the coupling section 33, and the fixing bridge 47 which is arranged therebetween and which the neck strap 17 passes at the second side 37 of the coupling section 33. Said center section 23 of the neck strap 17 thereby contacts the two connection bridges 45 in each case with a first side surface 61 of the neck strap 17 designed as a (narrow) flat strap and contacts the fixing bridge 47 with a second side surface 63 of the neck strap 17 opposite the first side surface 61 (cf. FIG. 1).

Depending on how tightly the neck strap 17 is tensioned in this respect, the neck strap 17 is prevented from slipping through substantially along the transverse direction Q by more or less friction between the respective side surface 61, 63 and the respective connection bridge 45 or fixing bridge 47. To further increase the friction for a more reliable prevention of such a slipping through, the connection bridges 45 each have a braking structure 65 in the form of a toothing (cf. FIG. 2, wherein only the braking structure 65 at the one of the two connection bridges 45 can be seen due to the viewing direction). In this respect, the braking structure 65 in each case extends into the free space 43 so that the teeth of the toothing formed at the one connection bridge 45 and the teeth of the toothing formed at the other connection bridge 45 face toward one another. The fixing bridge 47 could generally also have a braking structure; furthermore, the braking structure 65 could also extend in another direction as long as it is arranged such that it may cooperate with the respective side surface 61, 63 of the neck strap 17 at least in a manner braking a slipping through of the neck strap 17.

Figure 4:
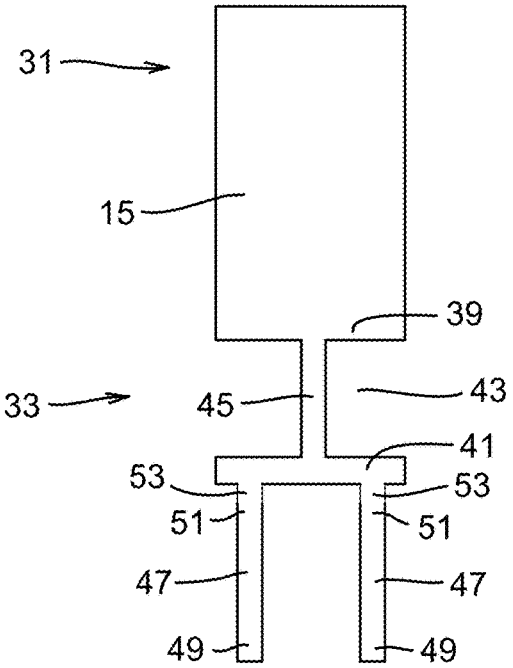
FIGS. 4 and 5 show, in a simplified representation, a holder according to a second embodiment of the disclosure, wherein fixing bridges of the holder are shown in a pre-assembly position in FIG. 4 and in a fixing position in FIG. 5.
Figure 5:
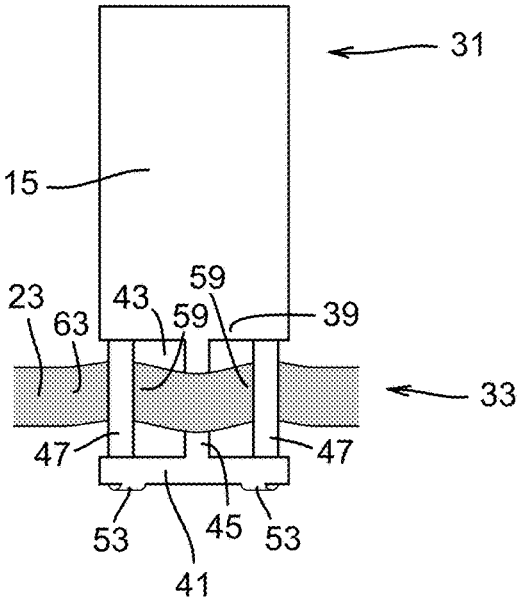

A further holder 15 that is configured according to a second or a third embodiment of the disclosure is shown in FIGS. 4 and 5 and FIGS. 6 and 7, respectively. The holders 15 are each shown greatly simplified. In FIGS. 4 and 5, the viewing direction is in each case such that only the first side 35 of the coupling section 33 of the holder 15 is visible, whereas, in FIGS. 6 and 7, the viewing direction is in each case such that only the second side 37 of the coupling section 33 of the holder 15 is visible.

In the following, the peculiarities of the second or third embodiment are in particular discussed in comparison with the first embodiment. Apart from these peculiarities, the holders 15 shown in FIGS. 4 to 7 may be configured at least substantially like the holder 15 shown in FIGS. 1 to 3. In this respect, the same reference numerals are in each case used for mutually corresponding elements of the various holders 15.

The three embodiments differ primarily in terms of the number and arrangement of the connection bridges 45 and fixing bridges 47 of the respective holder 15. In the second embodiment shown in FIGS. 4 and 5, fixing bridges 47 are provided where the connection bridges 45 are provided in the first embodiment and a connection bridge 45 is provided where the fixing bridge 47 is provided in the first embodiment. Thus, the holder 15 according to the second embodiment has a single connection bridge 45, which permanently connects the first marginal section 39 and the second marginal section 41 to one another, and two fixing bridges 47 that are movable between the pre-assembly position shown in FIG. 4 and the fixing position shown in FIG. 5 and that only connect the two marginal sections 39, 41 to one another in the fixing position.

In the second embodiment, the connection bridge 45 is arranged between the fixing bridges 47 with respect to the transverse direction Q. The free space 43 in the pre-assembly position of the fixing bridges 47 is thereby not bounded with respect to the transverse direction Q, but is divided into two laterally open intermediate spaces by the centrally arranged connection bridge 45. Only when the fixing bridges 47 are each in their fixing position and thus, like the connection bridge 45, connect the first marginal section 39 and the second marginal section 41 of the coupling section 33 to one another, are the intermediate spaces laterally closed so that the free space 43 is bounded with respect to the transverse direction Q by the fixing sections 47.

Similarly as in the first embodiment, the neck strap 17 may be connected to the holder 15 configured according to the second embodiment in that a continuous center section 23 of the neck strap 17 is arranged at the one connection bridge 45 at the first side 35 (facing towards the viewer in FIGS. 4 and 5) of the coupling section 33 and a (first) part section 59 of the center section 23 is then brought (to the rear) through one of the two intermediate spaces into which the free space 43 is divided by the connection bridge 45 to the second side 37 where it is engaged through by the fixing bridge 47 bounding this intermediate space by moving the fixing bridge 47 into its fixing position and is thereby secured against a return to the first side 35 of the coupling section 33. Furthermore, as shown in FIG. 5, a further (second) part section 59 of the center section 23 may likewise be brought (to the rear) through the other intermediate space to the second side 37 where it may be engaged through by the fixing bridge 47 bounding this intermediate space by moving the fixing bridge 47 into its fixing position and may thereby be secured against a return to the first side 35 of the coupling section 33.

Figure 6:
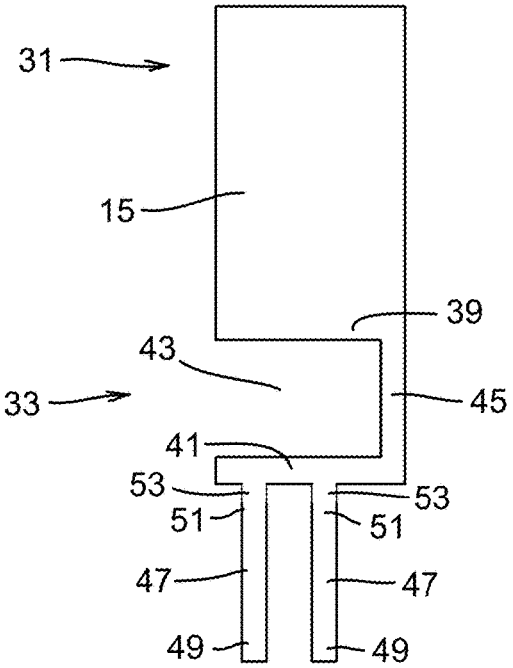
FIGS. 6 and 7 show, in a simplified representation, a holder according to a third embodiment of the disclosure, wherein fixing bridges of the holder are shown in a pre-assembly position in FIG. 6 and in a fixing position in FIG. 7.
Figure 7:
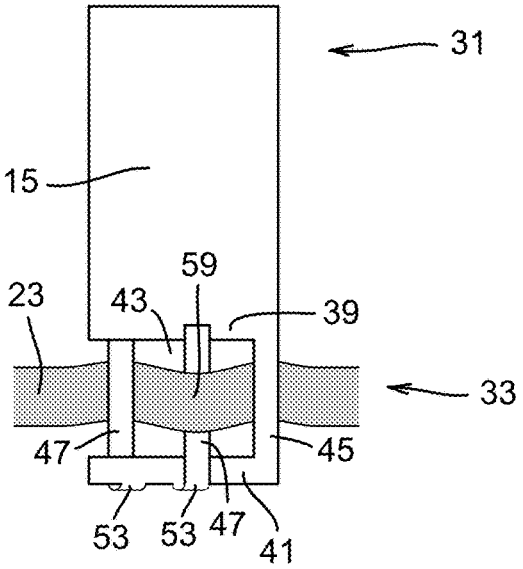

Like the second embodiment, the holder 15 shown in FIGS. 6 and 7 that is configured according to the third embodiment has only one connection bridge 45 and two fixing bridges 47. However, in the third embodiment, the connection bridge 45 is not arranged between the fixing bridges 47, but is laterally arranged with respect to the transverse direction Q so that it bounds the free space 43 formed between the marginal sections 39, 41 of the coupling section 33 in the transverse direction Q. In its fixing position, one of the two fixing bridges 47 bounds the free space 43 in the opposite direction and the other fixing bridge 47 is centrally arranged between this fixing bridge 47 and the connection bridge 45.

Furthermore, a peculiarity of the third embodiment that is expedient due to this arrangement of the bridges 45, 47 is that the middle one of the two fixing bridges 47 is arranged in its fixing position at the second side 37 (facing towards the viewer in FIGS. 6 and 7) of the coupling section 33 and is consequently supported at the second side 37 with its first support section 49 against the first marginal section 39 so that it is secured in a form-fitting manner against passing through the free space 43 (to the rear) towards the first side 35, whereas the outer one of the two fixing bridges 47 is arranged in its fixing position at the first side 35 of the coupling section 33 and is supported at the first side 35 with its first support section 49 against the first marginal section 39 so that it is secured in a form-fitting manner against passing through the free space 43 (to the front) towards the second side 37.

In this way, in the third embodiment, the neck strap 17 may also have a slalom-like course around the connection bridge 45 and the fixing bridges 47 and may be reliably connected to the holder 15 by the fixing bridges 47 in this respect. Again, the connection takes place in that a continuous center section 23 of the neck strap 17 is arranged at the one connection bridge 45 at the first side 35 (facing away from the viewer in FIGS. 6 and 7) of the coupling section 33 and a part section 59 of the center section 23 is then brought (to the front) through the free space 43 between the marginal sections 39, 41 of the coupling section 33 to the second side 37 where it is engaged through by the middle fixing bridge 47 by moving the latter into its fixing position and is thereby secured against a return to the first side 35 of the coupling section 33. In this respect, the center section 23 is furthermore held at the first side 35 by the outer fixing bridge 47 in its fixing position at the first side 35 (cf. FIG. 7).

All the embodiments of the holder 15 according to the disclosure thus make it possible in a simple manner to connect a continuous center section 23 of a neck strap 17 in a particularly reliable manner to the helmet shell 13 of a respective helmet 11 without the neck strap 17 having to be threaded through an eyelet or another closed structure for this purpose. This simplifies the manufacture of the helmet 11 and in particular also contributes to the possibility of the production being automated.

What is claimed is:

1. A holder for connecting a neck strap to a helmet shell of a helmet, wherein the holder has a fastening section for fastening to the helmet shell and a coupling section for connecting the neck strap, wherein the coupling section has a first side and a second side that are opposite one another with respect to a normal direction, wherein the coupling section further has a first marginal section and a second marginal section which are arranged opposite one another with respect to a longitudinal direction perpendicular to the normal direction and between which a free space is formed, wherein the coupling section further comprises one or more connection bridges that each permanently connect the first marginal section and the second marginal section to one another, wherein the holder further comprises at least one fixing bridge that can be moved from a position in which it does not connect the first marginal section and the second marginal section to one another into a fixing position in which it connects the first marginal section and the second marginal section to one another, and wherein the holder is configured such that a continuous center section of the neck strap can be arranged at the one or more connection bridges at the first side of the coupling section and a part section of the center section can be brought through the free space to the second side of the coupling section where it can be engaged through by the at least one fixing bridge by moving the latter into its fixing position and can thereby be secured against a return to the first side of the coupling section.

2. The holder according to claim 1, wherein the holder comprises at least two connection bridges and at least one fixing bridge that is arranged between the two connection bridges with respect to a transverse direction perpendicular to the normal direction and the longitudinal direction, or at least two fixing bridges and at least one connection bridge that is arranged between the two fixing bridges with respect to a transverse direction perpendicular to the normal direction and the longitudinal direction.

3. The holder according to claim 1, wherein the one or more connection bridges and/or the at least one fixing bridge has/have a braking structure that increases the friction between the neck strap and the respective connection bridge or fixing bridge.

4. The holder according to claim 1, wherein the at least one fixing bridge is formed separately from the coupling section.

5. The holder according to claim 4, wherein the at least one fixing bridge is formed as a metal pin separate from the coupling section.

6. The holder according to claim 1, wherein the at least one fixing bridge is integrally formed with the coupling section.

7. The holder according to claim 6, wherein the entire holder is formed in one part.

8. The holder according to claim 1, wherein the coupling section has, at its second side, a guide into which the fixing bridge is inserted in its fixing position.

9. The holder according to claim 1, wherein the at least one fixing bridge has a first support section with which it is arranged at the first marginal section in the fixing position and a second support section with which it is arranged at the second marginal section in the fixing position.

10. The holder according to claim 9, wherein, in the fixing position, the at least one fixing bridge is arranged with the first support section at the first marginal section and with the second support section at the second marginal section such that the first support section and the second support section are secured against passing through the free space towards the first side of the coupling section.

11. The holder according to claim 9, wherein, in the fixing position, at least one of the two support sections is fastened to the coupling section in a form-fitting manner.

12. The holder according to claim 9, wherein, in the fixing position, at least one of the two support sections is fastened to the coupling section by snapping in or clipping in.

13. The holder according to claim 9, wherein, in the fixing position, at least one of the two support sections is fastened or fastenable to the coupling section in a materially bonded manner.

14. The holder according to claim 9, wherein, in the fixing position, at least one of the two support sections is fastened or fastenable to the coupling section by welding or adhesive bonding.

15. The holder according to claim 11, wherein the fastening is irreversible.

16. The holder according to claim 9, wherein one of the two support sections is connected in an articulated manner to the coupling section.

17. The holder according to claim 16, wherein the at least one fixing bridge is integrally formed with the coupling section, and wherein the one support section is connected in an articulated manner to the coupling section via a film hinge or film joint.

18. The holder according to claim 1 installed in a helmet comprising a helmet shell for placing on the head and a neck strap for fastening the helmet to the head.

19. The holder according to claim 18, wherein the neck strap extends continuously from a first end to a second end and, with a center section of its extent, contacts the one or more connection bridges at the first side of the coupling section, wherein a part section of the center section extends through the free space to the second side of the coupling section where it is engaged through by the at least one fixing bridge in its fixing position so that said part section of the center section is secured against a return to the first side of the coupling section.

20. The holder according to claim 18, wherein the center section of the neck strap contacts the one or more connection bridges with a first side surface of the neck strap and contacts the at least one respective fixing bridge with a second side surface of the neck strap opposite said first side surface.

* * * * *